US007721649B2

(12) United States Patent
Hetz et al.

(10) Patent No.: US 7,721,649 B2
(45) Date of Patent: May 25, 2010

(54) INJECTION MOLDED SHAPED CHARGE LINER

(75) Inventors: Avigdor Hetz, Houston, TX (US); Clarence W. Wendt, Bellville, TX (US); John D. Loehr, Needville, TX (US); William B. Harvey, Houston, TX (US); David Betancourt, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 12/211,426

(22) Filed: Sep. 16, 2008

(65) Prior Publication Data

US 2009/0071361 A1 Mar. 19, 2009

Related U.S. Application Data

(60) Provisional application No. 60/973,032, filed on Sep. 17, 2007.

(51) Int. Cl.
*F42B 1/00* (2006.01)

(52) U.S. Cl. ..... 102/307; 89/1.15; 89/1.151; 419/65; 419/67

(58) Field of Classification Search ..... 89/1.15, 89/1.151; 419/65, 67; 102/306, 307
See application file for complete search history.

(56) References Cited

U.S. PATENT DOCUMENTS

| | | | | |
|---|---|---|---|---|
| 3,860,865 | A * | 1/1975 | Stroud et al. | 324/508 |
| 4,338,713 | A | 7/1982 | Christopher | |
| 4,613,370 | A | 9/1986 | Held et al. | |
| 5,221,808 | A | 6/1993 | Werner et al. | |
| 5,413,048 | A | 5/1995 | Werner et al. | |
| 5,567,906 | A | 10/1996 | Reese et al. | |
| 5,656,791 | A | 8/1997 | Reese et al. | |
| 5,814,758 | A | 9/1998 | Leidel | |
| 6,204,316 | B1 | 3/2001 | Schofalvi | |
| 6,296,044 | B1 | 10/2001 | Brooks et al. | |
| 6,350,407 | B1 | 2/2002 | Sakata et al. | |
| 6,371,219 | B1 | 4/2002 | Collins et al. | |
| 6,530,326 | B1 * | 3/2003 | Wendt et al. | 102/306 |
| 6,705,848 | B2 | 3/2004 | Scancarello | |

(Continued)

FOREIGN PATENT DOCUMENTS

| | | | |
|---|---|---|---|
| EP | 1134539 | A1 | 9/2001 |

(Continued)

OTHER PUBLICATIONS

WEBSITE http://metaor-imc.com/materials.htm, MIM Technology, 3 pages.

(Continued)

*Primary Examiner*—J. Woodrow Eldred
(74) *Attorney, Agent, or Firm*—Bracewell & Giuliani LLP

(57) ABSTRACT

A shaped charge liner formed by injection molding, where the liner comprises a powdered metal mixture of a first and second metal. The mixture includes about 50% to about 99% by weight percent of the first metal, about 1% to about 50% by weight percent of a second metal, about 1% to about 50% by weight percent of a third metal. In one embodiment, the first metal comprises tungsten, the second metal may comprise nickel, and the third metal may comprise copper.

16 Claims, 6 Drawing Sheets

U.S. PATENT DOCUMENTS

| | | | |
|---|---|---|---|
| 7,413,702 | B2 | 8/2008 | Lu et al. |
| 2007/0053785 | A1 | 3/2007 | Hetz |

FOREIGN PATENT DOCUMENTS

| | | | |
|---|---|---|---|
| EP | 1241433 | A2 | 9/2002 |
| WO | 2001096807 | A2 | 12/2001 |
| WO | 2005035929 | A2 | 4/2005 |

OTHER PUBLICATIONS

International Search Report and PCT Written Opinion dated Mar. 3, 2009, 10 pages.

* cited by examiner

INJECTION MOLDED SHAPED CHARGE LINER

RELATED APPLICATIONS

This application claims priority to and the benefit of co-pending U.S. Provisional Application Ser. No. 60/973,032, filed Sep. 17, 2007, the full disclosure of which is hereby incorporated by reference herein.

BACKGROUND OF THE INVENTION

1. Field of the Invention

The invention relates generally to the field of oil and gas production. More specifically, the present invention relates to an injection molded shaped charge liner formed from a heavy metal and a binder. Yet more specifically, the present invention relates to a shaped charge liner comprising a mixture of tungsten, copper, and nickel.

2. Description of Related Art

Perforating guns are used for the purpose, among others, of making hydraulic communication passages, called perforations, in wellbores drilled through earth formations so that predetermined zones of the earth formations can be hydraulically connected to the wellbore. Perforations are needed because wellbores are typically completed by coaxially inserting a pipe or casing into the wellbore, and the casing is retained in the wellbore by pumping cement into the annular space between the wellbore and the casing. The cemented casing is provided in the wellbore for the specific purpose of hydraulically isolating from each other the various earth formations penetrated by the wellbore.

Shaped charges known in the art for perforating wellbores are used in conjunction with a perforation gun. One embodiment of a traditional shaped charge 5 is illustrated in FIG. 1. As shown, shaped charge 5 includes a housing 6, a liner 10, and a quantity of high explosive 8 inserted between the liner 10 and the housing 8 where the high explosive 8 is usually HMX, RDX PYX, or HNS. When the high explosive 8 is detonated, the force of the detonation collapses the liner 10 and ejects it from one end of the charge at very high velocity in a pattern called a "jet". The jet penetrates the casing, the cement and a quantity of the formation.

Some of the traditional methods of producing shaped charge liners include sintering and cold working. Cold working involves mixing a powdered metal mix in a die and compressing the mixture under high pressure into a shaped liner. One of the problems associated with cold working a liner is a product having inconsistent densities. This is usually caused by migration of either the binder or the heavy metal to a region thereby producing a localized density variation. A lack of density homogeneity curves the path of the shaped charge jet that in turn shortens the length of the resulting perforation. This is an unwanted result since shorter perforations diminish hydrocarbon production.

Cold worked liners have a limited shelf life since they are susceptible to shrinkage thereby allowing gaps to form between the liners and the casing in which they are housed. These liners also tend to be somewhat brittle which leads to a fragile product. Liners produced by cold working may slightly expand after being assembled and stored; this phenomenon is also referred to as creep. Even a slight expansion of the shaped charge liner reduces shaped charge effectiveness and repeatability. Additionally, liner density also affects liner performance. Increasing liner density correspondingly increases jet density that in turn deepens shaped charge penetrations. However the cold forming process allows for low density regions in the liner thus resulting in an upper limit on liner density.

Sintered liners necessarily involve a heating step of the liner, wherein the applied heating raises the liner temperature above the melting point of one or more of the liner constituents. The melted or softened constituent is typically what is known as the binder. During the sintering or heating step, the metal powders coalesce while their respective grains increase in size. The sintering time and temperature will depend on what metals are being sintered. The sintering process forms crystal grains thereby increasing the final product density while lowering the porosity. Sintering is generally performed in an environment void of oxygen or in a vacuum. However the ambient composition within a sintering furnace may change during the process, for example the initial stages of the process may be performed within a vacuum, with an inert gas added later. Moreover, the sintering temperature may be adjusted during the process, wherein the temperature may be raised or lowered during sintering.

Prior to the sintering step the liner components can be cold worked as described above, injection molded, or otherwise formed into a unitary body. However the overall dimensions of a sintered liner can change up to 20% from before to after the sintering step. Because this size change can be difficult to predict or model, consistently producing sintered shaped charge liners that lie within dimensional tolerances can be challenging. Information relevant to shaped charge liners formed with powdered metals is addressed in Werner et al., U.S. Pat. No. 5,221,808, Werner et al., U.S. Pat. No. 5,413,048, Leidel, U.S. Pat. No. 5,814,758, Held et al. U.S. Pat. No. 4,613,370, Reese et al., U.S. Pat. No. 5,656,791, and Reese et al., U.S. Pat. No. 5,567,906.

Therefore, there exists a need for a method of consistently manufacturing shaped charge liners, wherein the resulting liners have a homogenous density, have consistent properties between liner lots, have a long shelf life, and are resistant to cracking.

BRIEF SUMMARY OF THE INVENTION

The present invention involves a method of injection molding a shaped charge liner with a metal powder of a first metal, a second metal, and a third metal, where the first metal is about 50%-99% by weight, the second metal is about 1%-40% by weight, and the third metal is about 1%-40% by weight. The first metal density exceeds about 11 gm/cc and may comprise tungsten and the second metal may comprise nickel, copper, and metals whose density is less than about 10 gm/cc, and combinations thereof. The metal powder can be chosen from these listed metals singularly or can come from combinations thereof. The liner may be combined with a shaped charge as a green part without any processing after being molded, combined after debinding the liner, or combined after being sintered.

A binder may be included comprising a polyolefine, an acrylic resin, a styrene resin, polyvinyl chloride, polyvinylidene chloride, polyamide, polyester, polyether, polyvinyl alcohol, paraffin, higher fatty acid, higher alcohol, higher fatty acid ester, higher fatty acid amide, wax-polymer, acetyl based, water soluble, agar water based and water soluble/cross-linked. The binder can be chosen from these listed binders singularly or can come from combinations thereof.

The present method disclosed herein further comprises forming a shaped charge with the shaped charge liner, disposing the shaped charge within a perforating gun, combining the perforating gun with a perforating system, disposing the perforating gun within a wellbore, and detonating the shaped charge.

An alternate method of forming a shaped charge liner is disclosed herein comprising, combining powdered metal with organic binder to form a mixture, passing the mixture through an injection molding device, ejecting the mixture from the injection molding device into a mold thereby forming a liner shape in the mold, and debinding the binder from the liner shape; wherein the liner shape is sintered. The alternate method further comprises placing the liner shape in a vacuum. The alternate method of forming a shaped charge liner may also comprise forming a shaped charge with said shaped charge liner, disposing the shaped charge within a perforating gun, combining the perforating gun with a perforating system, disposing the perforating gun within a wellbore, and detonating the shaped charge.

DETAILED DESCRIPTION OF THE INVENTION

The present disclosure involves a shaped charge liner and a method of making the shaped charge liner. The method disclosed herein involves a form of metal injection molding wherein metal powders are mixed with binders and the mixture is subsequently injected under pressure into a mold. The binder is then removed during a de-binding process in order to form the final product.

Figure 2:
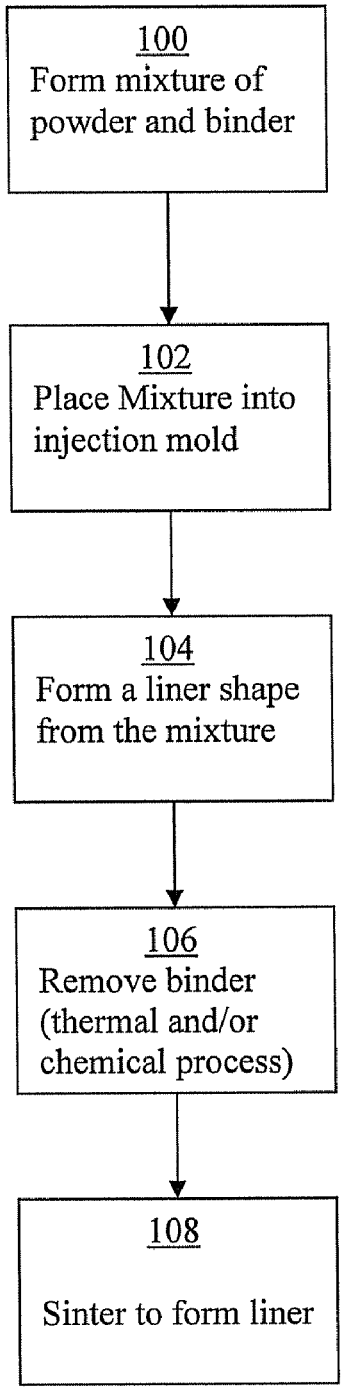
FIG. 2 represents in flow chart form an embodiment of a liner forming process.

With reference now to FIG. 2, an embodiment of forming a liner in accordance with the present disclosure is shown in flow chart form. Initially an amount of metal powder is combined with an amount of binder to form a mixture (step 100). The amount of metal powder of the mixture can range from about 20% up to about 100%, therefore the amount of binder will range from about 0% to about 80%. The particulate size of the powdered metal can range from about 1 micron to in excess of 70 microns.

The powdered metal can be chosen from the list comprising: tungsten, uranium, hafnium, tantalum, nickel, copper, molybdenum, lead, bismuth, zinc, tin, silver, gold, antimony, cobalt, zinc alloys, tin alloys, nickel, palladium, and combinations thereof. Optionally, in place of the powdered metal, other materials such as ceramic, high density polymers, or cementitious materials can be substituted. Another option is to use a coated powder metal, where the coating typically comprises a metal whose hardness is less than that of the particle being coated.

The binder can be selected from the list comprising: polyolefines such as polyethylene, polypropylene, polystyrenes, polyvinyl chloride, polyetheylene carbonate, polyethylene glycol, microcrystalline wax, ethylene-vinyl acetate copolymer and the like; acrylic resins such as polymethyl methacrylate, polybutyl methacrylate; styrene resins such as polystyrene; various resins such as polyvinyl chloride, polyvinylidene chloride, polyamide, polyester, polyether, polyvinyl alcohol, copolymers of the above; various waxes; paraffin; higher fatty acids (e.g., stearic acid); higher alcohols; higher fatty acid esters; higher fatty acid amides. Other binder possibilities include: acetyl based, water soluble, agar water based and water soluble/cross-linked; acetyl based binders comprise polyoxymethylene or polyacetyl with small amounts of polyolefin. The use of metal injection molded binders is well known and thus the size of the binder particulate can vary depending on the type of binder and/or the application. Accordingly, choosing a proper binder particulate size is within the scope of those skilled in the art.

Figure 3:
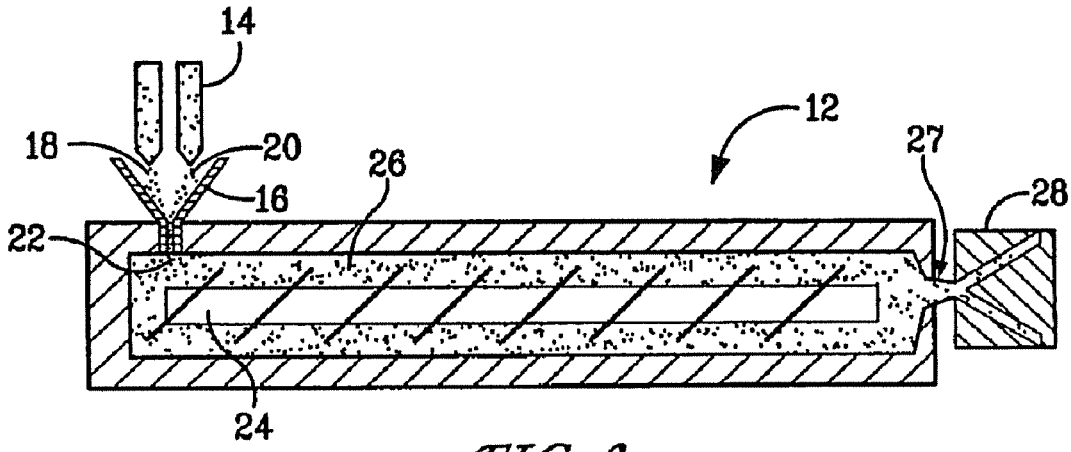
FIG. 3 illustrates a cross sectional view of an injection molding device.

Upon forming the mixture 22 of the metal powder and binder the mixture 22 is injection molded (step 102). One embodiment of injection molding the mixture 22 employs an injection molding device 12, an example of which is shown in FIG. 3. In this embodiment, both the powder 18 and the binder 20 are directed through respective dispensers 14 to a chute 16, where the chute in turn guides the mixture 22 into the injection molding device 12. The mixture 22 can be formed within the chute 16, the injection molding device 12, or alternatively, the mixture 22 can be formed prior to being directed into the chute 16. Once inside the injection molding device 12, the mixture 22 is within the plenum 26 of the injection molding device 12. Rotation of an auger 24 disposed within the plenum 26 agitates the mixture 22 thereby insuring a uniformity of the mixing of the binder and powder. The auger 24 action also directs the mixture 22 towards an exit port 27 disposed on the side of the injection molding device 12 distal from the chute 16. Moreover, the auger 24 provides a source of pressure for urging the mixed and homogenous mixture 22 from within the plenum 26 through the exit port 27 and into the inner confines of a mold 28. Urging the mixture 22 into the mold 28 under pressure forms a liner shape 30 having the constituents of the mixture 22 (step 104).

Figure 4:
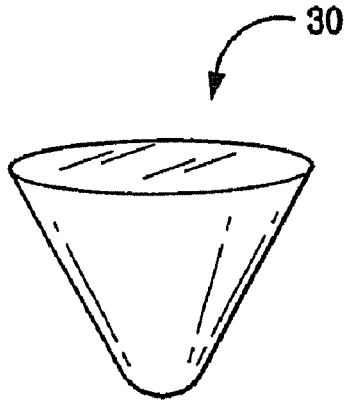
FIG. 4 portrays a side view of a liner shape.

One embodiment of a liner shape 30 is shown in FIG. 4. It should be pointed out that this liner has but one of the possible shapes that could be formed from the mixture 22 described herein. With regards to an actual liner 10 made in accordance with the method and process described herein, any liner shape could be formed with this process. Shapes such as conical frusto-conical, triangular, tulip and trumpet shape, and parabolic shapes, to name but a few, are considered within the scope and purview of the present invention.

Optionally, binder in the liner shape 30 can be removed after the shape 30 is taken from the mold 28. Removing the binder can be done both chemically, i.e. with solvents or liquids, and thermally by heating the liner shape. Mechanical or chemical debinding can begin with applying to the shape 30 a debinding liquid or solvent (step 106). This step involves chemically dissolving the organic binder with the de-binding liquid. Debinding can occur at atmosphere or under vacuum. The debinding solutions for use with the present method include water, nitric acid, and other organic solvents. However any suitable debinding solution can be used with the present method and skilled artisans are capable of choosing an appropriate debinding solution. During debinding, the liner shape 30 can be sprayed with the de-binding liquid or placed in a bath of de-binding solution.

After the liner shape 30 is processed with the liquid debinding solution, the remaining binder is removed during a thermal de-binding process (step 106). The thermal de-binding process involves placing the liner shape into a heated unit, such as a furnace, where it is heated at temperature for a period of time. With regard to the de-binding temperature, it should be sufficient to cause it to remove remaining binder within the liner that remains after chemical de-binding and yet be low enough to not exceed the melting point of a metal powder used as part of the liner constituency. It is believed as well within the capabilities of those skilled in the art to determine a proper temperature and corresponding heating time to accomplish this process.

An optional sintering process (step 108) may be implemented. The shape 30 can be sintered in addition to debinding or sintered without debinding. Sintering comprises placing the liner shape into a furnace at a temperature sufficient to soften the metal particles without melting them. Softening the particles causes particle adhesion and removes voids or interstices between adjacent particles, thereby increasing liner density.

In an optional embodiment, the method comprises forming a shaped charge 5*a* using the liner shape 30 formed in the injection molding process, without de-binding, sintering, or otherwise heating or other treatment of the injection molded product. The shaped charge 5*a* comprising the injection molded formed liner can then be included within a perforating system, disposed within a wellbore, and detonated. Such an injection molded part implemented for final use without a debinding step, or other treatment such as sintering or heating, can be referred to as a green part. Thus a green part liner 30 could be used as the final product liner in a shape charge 5*a*. Accordingly instead of a liner that had its binder removed during a de-binding process (step 106), in an alternative embodiment a shaped charge 5*a* comprising a green part liner 30 can be formed and used as part of a perforating system. An advantage of a green part is because it is not heated, its final dimensions do not change after the injection molding process, unlike products subjected to heating and injection molding. Accordingly the size of the mold 28 could be more accurate in conforming to the required size of the final product.

In one embodiment, the injection molded liner has a density ranging from about 15 gm/cc to about 19 gm/cc, in another embodiment the liner density ranges from about 16 gm/cc to about 18 gm/cc, in yet another embodiment the liner density is about 17.6 gm/cc.

In one embodiment the liner composition comprises a mixture of a first metal, a second metal, and an optional third metal. The first metal has, in one embodiment, a density greater than about 11 gm/cc, in another embodiment a density greater than about 13 gm/cc, in another embodiment a density greater than about 15 gm/cc, in another embodiment a density greater than about 17 gm/cc, and in another embodiment a density greater than about 19 gm/cc. The second metal has, in one embodiment, a density up to about 10 gm/cc, in another embodiment a density up to about 9 gm/cc, in another embodiment a density up to about 8.8 gm/cc, in another embodiment a density up to about 8.5 gm/cc, and in another embodiment a density greater than 19 gm/cc. The third metal may have a density up to about 10 gm/cc, in one embodiment a density up to about 9 gm/cc, in another embodiment a density up to about 8.8 gm/cc, in another embodiment a density up to about 8.5 gm/cc, and in another embodiment a density greater than 19 gm/cc.

The mixture, in one embodiment, comprises from about 50% to about 99% by weight of the first metal, and about 1% to about 50% by weight of the second metal. In another embodiment, the mixture comprises from about 50% to about 98% by weight of the first metal, about 1% to about 40% by weight of the second metal, and about 1% to about 40% by weight of the third metal. In another embodiment, the mixture comprises from about 50% to about 98% by weight of the first metal, about 1% to about 40% by weight of the second metal, and about 1% to about 40% by weight of the third metal. In another embodiment, the mixture comprises from about 60% to about 95% by weight of the first metal and about 5% to about 15% of the second metal, and about 5% to about 15% of the third metal. In another embodiment, the mixture comprises about 92% by weight of the first metal and up to about 8% of the second metal, and up to about 8% of the third metal. The first metal may comprise tungsten, the second metal may comprise nickel, and the third metal may comprise copper. In one embodiment, the liner comprises greater than 97% by weight of tungsten, in another embodiment the liner comprises greater than 97% by weight of tungsten up to about 99% by weight of tungsten.

Figure 5:
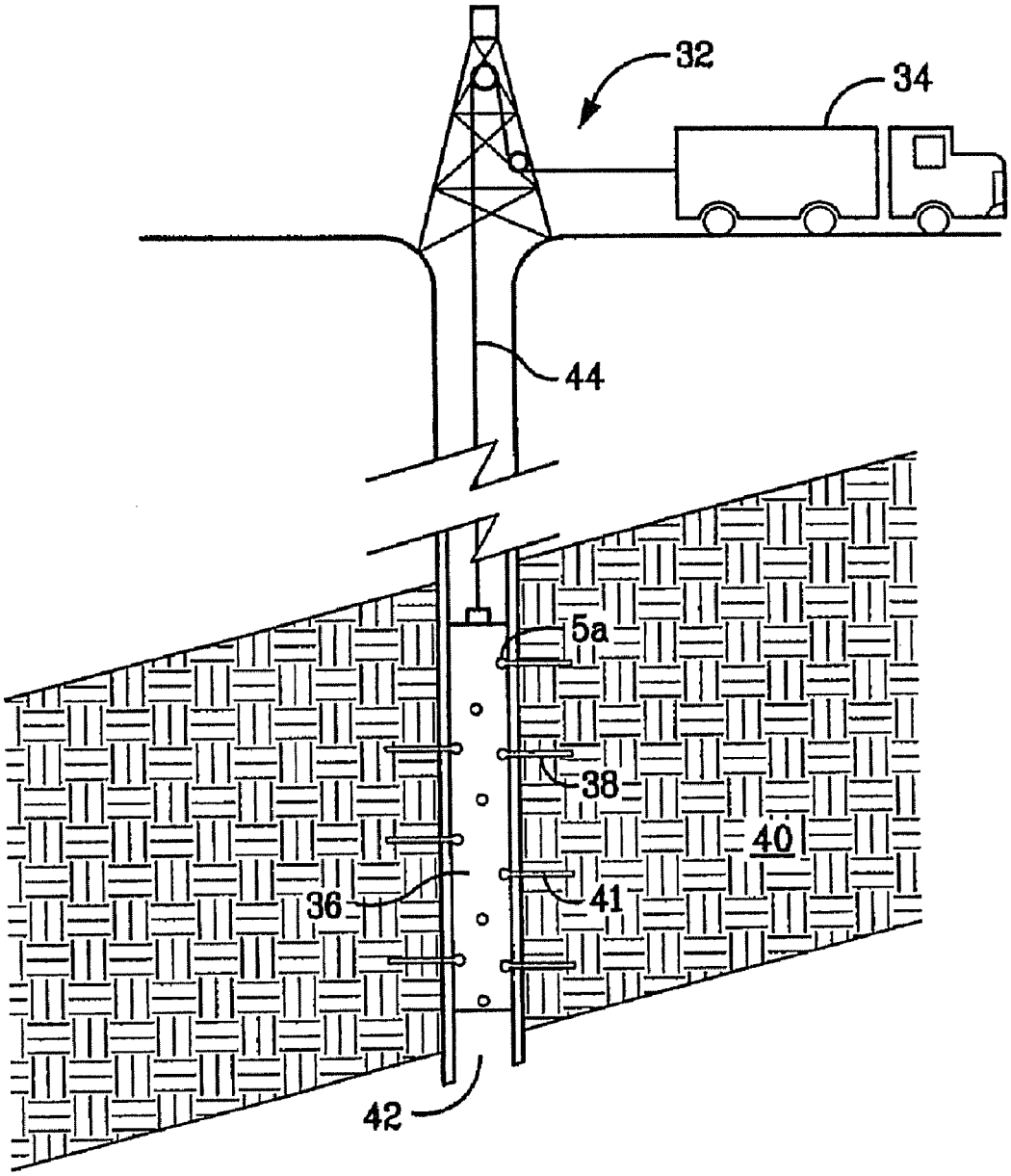
FIG. 5 is a cut away view of a perforating system with detonating shaped charges.

With reference now to FIG. 5 one embodiment of the final product of the present disclosure is shown combined with a perforating system 32. The perforating system 32 comprises a perforating gun 36 disposed within a wellbore 42 by a wireline 44. As shown, the surface end of the wireline 44 is in communication with a field truck 34. The field truck 34 can provide not only a lowering and raising means, but also surface controls for controlling detonation of the shaped charges of the perforating gun 36. With regard to this embodiment, the liner 10*a* is made in accordance with the disclosure herein is combined with a shaped charge 5*a* that is disposed in the perforating gun 36. Also shown are perforating jets 38, created by detonation of each shaped charge 5*a* thereby creating perforations 41 within the formation 40 surrounding the wellbore 42. Accordingly the implementation of the more homogenous and uniform liner material made in accordance with the method described herein is capable of creating longer and straighter perforations 41 into the accompanying formation 40.

Figure 1:
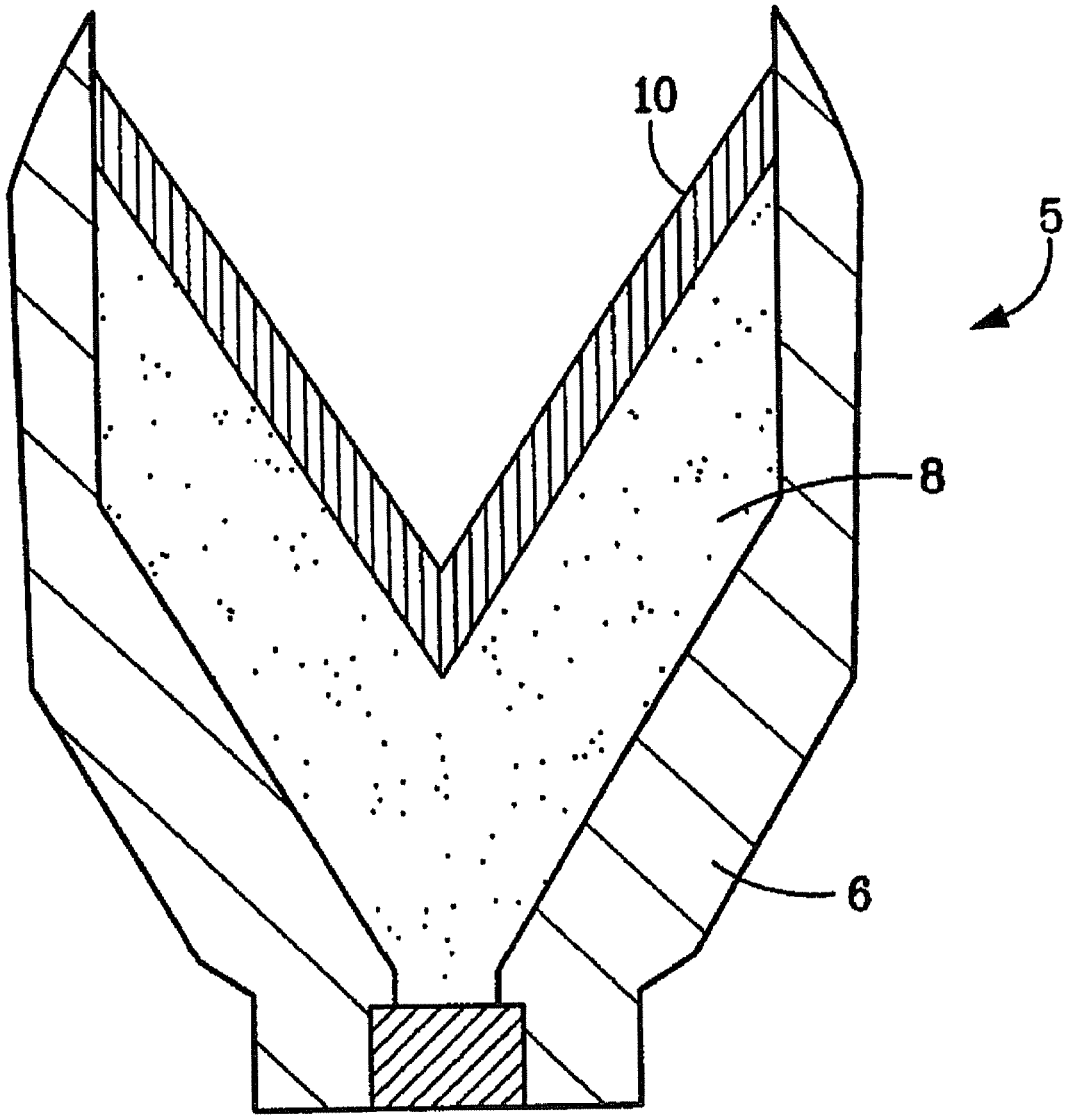
FIG. 1 depicts a perspective cross sectional view of a shaped charge.
Figure 6:
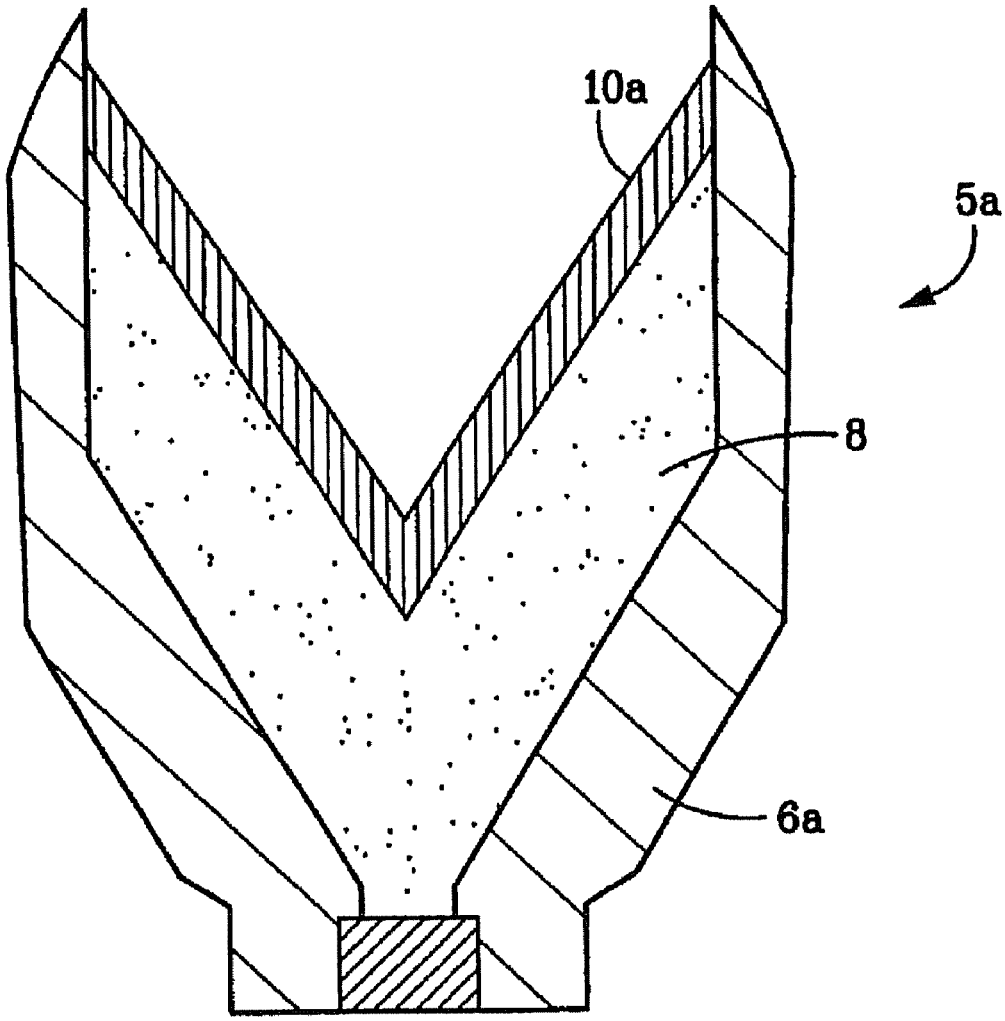
FIG. 6 is a cross sectional view of an embodiment of a shaped charge having a liner formed by the process described herein.
Figure 7:
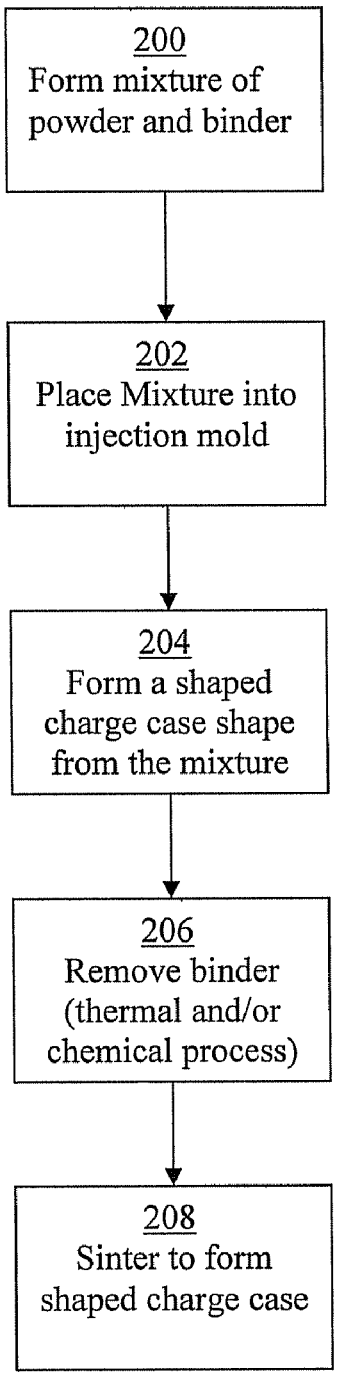
FIG. 7 represents in flow chart form an embodiment of a shaped charge case forming process.

It should be pointed out that the shaped charge 5*a* of FIG. 6 has essentially the same configuration as the shaped charge 5 of FIG. 1. FIG. 6 is provided for clarity and to illustrate that shaped charges having the traditional configuration can be formed with a liner 10*a* made in accordance with the disclosure provided herein. Moreover, the formation process disclosed herein can also be applicable for the forming of a charge case or housing. As seen in FIG. 7, a process similar to that of FIG. 2 is illustrated. With regard to the process of FIG. 7, a mixture of metal powder and binder is formed (step 200). The metal powder used in the formation of a charge case includes the metals used in the liner formation and further comprises steel such as carbon steel and stainless steel and other metals including monel, inconel, as well as aluminum.

Also similar to the process of forming a liner, after mixing the shaped charge case components, the mixture is directed to an injection mold (step 202). Moreover, the injection mold can be the same as or substantially similar to the injection molding device 12 of FIG. 3. The mixture can be formed prior to being placed in the injection molding device or can be formed while in the injection molding device. Steps 204, 206, and 208 of FIG. 7 are substantially similar to the corresponding steps 104, 106, and 108 of FIG. 2. One difference however between formation of the charge case and liner is that the charge case forming step (step 204) would require a mold having a charge case configuration instead of a liner shaped mold. Also similarly, the present method can involve producing an injection molded charge case without the de-binding or sintering steps thereby producing a "green part" charge case. While the sintering temperature and time of sintering depends on the constituent metals and their respective amounts, it is within the scope of those skilled in the art to determine an appropriate sintering temperature, time, as well as other furnace conditions, such as pressure and ambient components.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

The invention claimed is:

1. A method of forming a shaped charge comprising:

forming a metal powder mixture comprising tungsten in an amount from about 50 percent by weight to about 98 percent by weight, nickel in an amount from about 1 percent by weight to about 40 percent by weight, and copper in an amount from about 1 percent by weight to about 40 percent by weight;

adding an injection molding binding agent to the metal powder mixture;

injection molding a shaped charge liner using the metal powder mixture with added injection molding binding agent; and forming a shaped charge by inserting the shaped charge liner into a shaped charge case, the shaped charge case having explosive therein, wherein the shaped charge liner is inserted into the shaped charge case without being heating and without removing the injection molding binding agent.

2. The method of claim 1, wherein the metal powder mixture comprises tungsten in an amount from about 50 percent by weight up to less than 60 percent by weight, nickel in an amount from about 1 percent by weight to about 40 percent by weight, and copper in an amount from about 1 percent by weight to about 40 percent by weight.

3. The method of claim 1, wherein the metal powder mixture comprises tungsten in an amount from about 50 percent by weight up to less than 60 percent by weight, nickel in an amount from about 1 percent by weight to about 40 percent by weight, and copper in an amount from about 1 percent by weight to about 40 percent by weight.

4. The method of claim 1, further comprising substituting the tungsten with a metal having a density of about 11 grams per cubic centimeter or greater.

5. The method of claim 1, further comprising substituting the nickel with a metal having a density of about 10 grams per cubic centimeter or less.

6. The method of claim 1, further comprising substituting the copper with a metal having a density of about 10 grams per cubic centimeter or less.

7. The method of claim 1 further comprising, installing the shaped charge into a perforating gun, disposing the perforating gun in a wellbore, and detonating the shaped charge.

8. A shaped charge for use in a subterranean perforating gun, the shaped charge comprising:

a shaped charge case;

explosive in the case; and a shaped charge liner inserted in the case above the explosive, the shaped charge liner formed by injection molding a metal powder mixture comprising tungsten in an amount from about 50 percent by weight to about 98 percent by weight, nickel in an amount from about 1 percent by weight to about 40 percent by weight, and copper in an amount from about 1 percent by weight to about 40 percent by weight, wherein the shaped charge liner is formed without heating or debinding.

9. The shaped charge of claim 8, wherein the metal powder mixture comprises tungsten in an amount from about 50 percent by weight up to less than 60 percent by weight, nickel in an amount from about 1 percent by weight to about 40 percent by weight, and copper in an amount from about 1 percent by weight to about 40 percent by weight.

10. The shaped charge of claim 8, wherein the metal powder mixture comprises tungsten in an amount from about 50 percent by weight up to less than 60 percent by weight, nickel in an amount from about 1 percent by weight to about 40 percent by weight, and copper in an amount from about 1 percent by weight to about 40 percent by weight.

11. The shaped charge of claim 8, wherein at least a portion of the tungsten is substituted with a metal having a density of about 11 grams per cubic centimeter or greater.

12. The shaped charge of claim 8, wherein at least a portion of the nickel is substituted with a metal having a density of about 10 grams per cubic centimeter or less.

13. The shaped charge of claim 8, wherein at least a portion of the copper is substituted with a metal having a density of about 10 grams per cubic centimeter or less.

14. A subterranean perforating system comprising:

a surface control;

a perforating string disposed in a wellbore in communication with the surface control, the perforating string having a perforating gun; and a shaped charge in the perforating gun, the shaped charge comprising, a shaped charge case, explosive in the case, and a shaped charge liner inserted in the case above the explosive, the shaped charge liner formed by injection molding a metal powder mixture comprising tungsten in an amount from about 50 percent by weight to about 98 percent by weight, nickel in an amount from about 1 percent by weight to about 40 percent by weight, and copper in an amount from about 1 percent by weight to about 40 percent by weight, wherein the shaped charge liner is formed without heating or debinding.

15. A method of forming a shaped charge comprising:

providing a mixture comprising a metal powder;

adding an injection molding binding agent to the mixture;

injection molding a shaped charge liner the mixture with added injection molding binding agent;

and forming a shaped charge by inserting the injection molded shaped charge liner into a shaped charge case having explosive therein, without debinding the binding agent from the injection molded shaped charge liner and without sintering the injection molded shaped charge liner.

16. The method of claim 15 wherein the metal powder mixture comprises greater than 97% by weight of tungsten.

* * * * *